US006530153B1

(12) United States Patent
Kleban

(10) Patent No.: US 6,530,153 B1
(45) Date of Patent: Mar. 11, 2003

(54) COSMETIC PENCIL SHARPENER

(76) Inventor: Dianne Kleban, P.O. Box 97, Milford, MI (US) 48381-0097

( * ) Notice: Subject to any disclaimer, the term of this patent is extended or adjusted under 35 U.S.C. 154(b) by 78 days.

(21) Appl. No.: 09/784,986

(22) Filed: Feb. 15, 2001

Related U.S. Application Data

(60) Provisional application No. 60/186,617, filed on Mar. 3, 2000.

(51) Int. Cl.[7] ..... B43L 23/08
(52) U.S. Cl. ..... 30/454; 30/459
(58) Field of Search ..... 30/451, 453, 454, 30/457, 458, 459

(56) References Cited

U.S. PATENT DOCUMENTS

| | | | | | |
|---|---|---|---|---|---|
| 2,069,619 | A | * | 2/1937 | Mendelson | 30/459 |
| 2,169,908 | A | * | 8/1939 | Wells | 30/454 |
| 4,248,283 | A | * | 2/1981 | Laye | 30/454 |
| 4,281,698 | A | * | 8/1981 | Mobius | 30/454 |
| 4,402,354 | A | * | 9/1983 | Halpern | 30/454 |
| 4,726,387 | A | * | 2/1988 | Sarica | 132/85 |
| 4,799,503 | A | * | 1/1989 | Tahara | 220/260 |
| 5,323,924 | A | * | 6/1994 | Wolf | 220/410 |
| 5,431,176 | A | * | 7/1995 | Favre | 132/295 |
| 5,655,553 | A | * | 8/1997 | Giese et al. | 132/303 |
| 5,774,995 | A | * | 7/1998 | Ross | 30/454 |
| 6,089,376 | A | * | 7/2000 | Petit et al. | 206/581 |
| 6,138,686 | A | * | 10/2000 | Yuhara | 132/294 |
| 6,286,218 | B1 | * | 9/2001 | Luttgens | 30/454 |

FOREIGN PATENT DOCUMENTS

| | | |
|---|---|---|
| GB | 359555 | * 10/1931 |

* cited by examiner

*Primary Examiner*—Hwei-Siu Payer
(74) *Attorney, Agent, or Firm*—Robert Ryan Morishita; Anderson & Morishita

(57) ABSTRACT

A device for sharpening cosmetic pencils of the type having a core surrounded by an annular barrel includes a container with an open end and a cover mounted to the open end of the container. The cover has holes of at least three different diameters arrayed thereon. A sharpener having a receiver and a metal blade is disposed in registration with each of the holes between the container and the cover. Optionally, a case with supports and a receptacle to removably matingly receive the container can be provided. The case can include one or more of the following: compartments independent the receptacle and one another; a mirror mounted to a backing slidably connected to the supports; and a plurality of wells disposed in the supports.

15 Claims, 6 Drawing Sheets

COSMETIC PENCIL SHARPENER

RELATED APPLICATION DATA

The present application claims the priority of U.S. Provisional Application No. 60/186,617 entitled "Self Contained Eye and Lip Pencil Sharpener" filed Mar. 3, 2000 by Applicant herein.

FIELD OF THE INVENTION

The present invention relates to cosmetic pencil sharpeners. More specifically, the present invention is a cosmetic pencil sharpener that may be used to sharpen cosmetic pencils of various diameters.

BACKGROUND OF THE INVENTION

Pencil sharpeners are well known in the art. Conventional pencil sharpeners typically include a blade held at an angle to the pencil so that the annular barrel of the pencil may be shaved away from the core to create a point at the end of the pencil. However, a drawback of conventional pencil sharpeners is that pencil barrels vary in diameter. Thus, they cannot properly support the pencil during sharpening because for optimum use, the pencil sharpener has an inlet having substantially the same diameter as the pencil.

Also, pencil sharpeners of the prior art were inconvenient because they are often separate from the pencils so that when a user desires to sharpen a pencil, the sharpener must be found.

Thus, it can be seen that there is a need in the art for a pencil sharpener that is usable with pencils of a variety of sizes.

SUMMARY OF THE INVENTION

The present invention is a device for sharpening cosmetic pencils of the type having a core surrounded by an annular barrel. The invention includes a container to capture shavings from the sharpened pencil. The container has a base, side walls, and an open end. The container may optionally include an opening in the side walls to allow access to the interior of the container. Optionally, a door may cover the opening.

A cover is mounted to the open end of the container. The cover has a number of holes of at least three different diameters through its surface. Between the container and the cover, a sharpener is disposed in registration with each of the holes. The sharpener includes a receiver and a metal blade positioned at an angle to the receiver.

In an optional embodiment, the present invention further includes a case. The case includes supports and a receptacle that matingly receives the container. Optionally, the receptacle is complementary to the shape of the container and is located in the top of the case.

A variety of enclosures, containers, and receptacles may be mounted to, or disposed on, the case. For example, the case may optionally include a closeable storage chamber disposed in one of said supports. This storage chamber may be pivotally connected to the support. Similarly, the case may optionally include one or more compartments that are independent of one another and independent of the receptacle. In one such an embodiment, the compartments may be substantially parallel to the receptacle. Likewise, in an optional embodiment, the case may include a number of wells disposed in the supports at an acute angle. The wells may optionally vary in diameter.

In a further optional embodiment, the case may include a mirror mounted to a backing slidably connected to the supports. In such an optional embodiment, the slidable connection allows the mirror to be moved between a stored position in which the mirror is enclosed in the case and a deployed position in which the mirror is exposed. In a further optional embodiment, the backing is mounted near the bottom of the supports so that the backing forms the base of the case when the backing is in the stored postion.

DESCRIPTION

Figure 1:
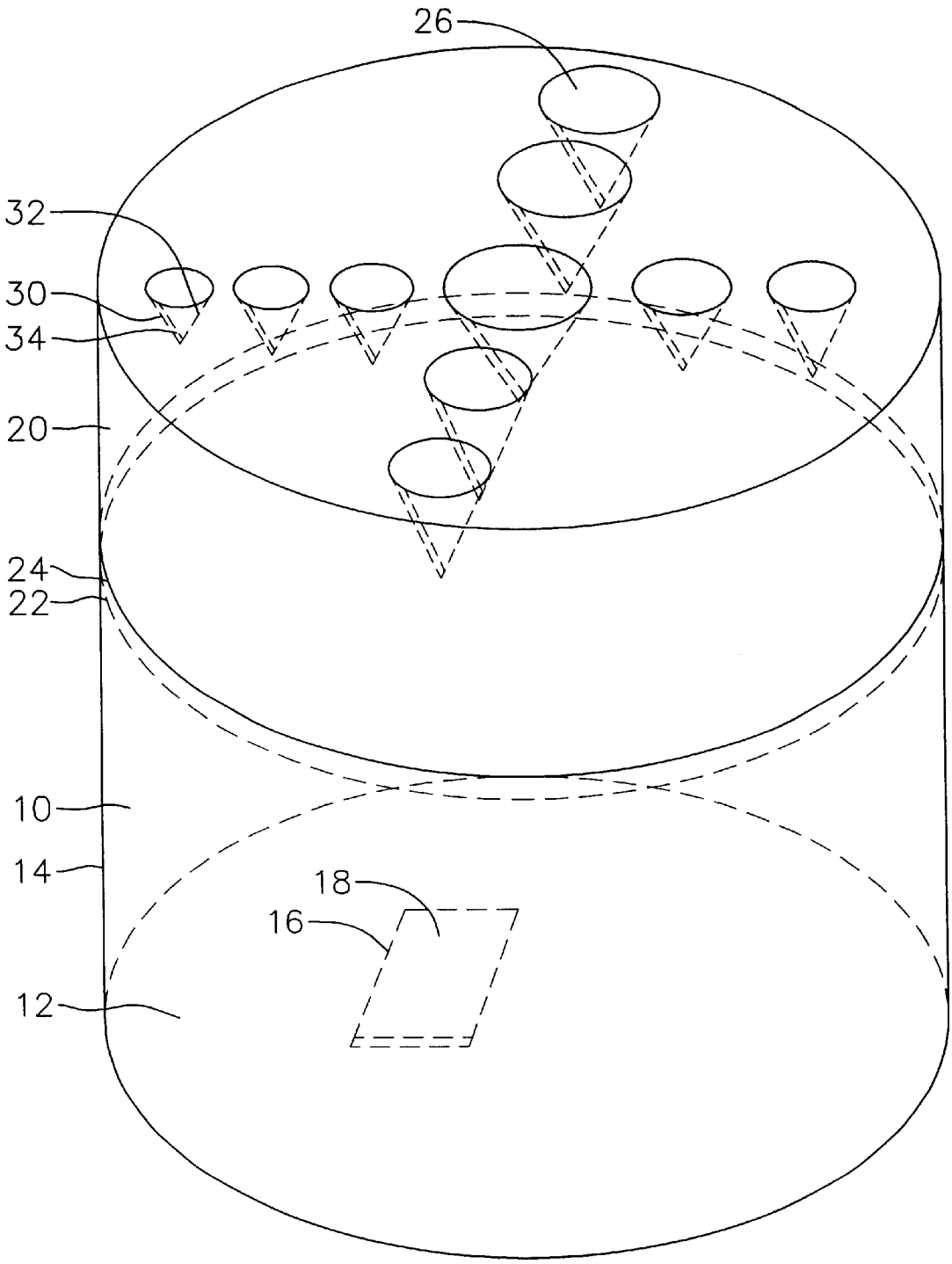
FIG. 1 is an elevated perspective view of an embodiment of the container and cover of the present invention.
Figure 2:
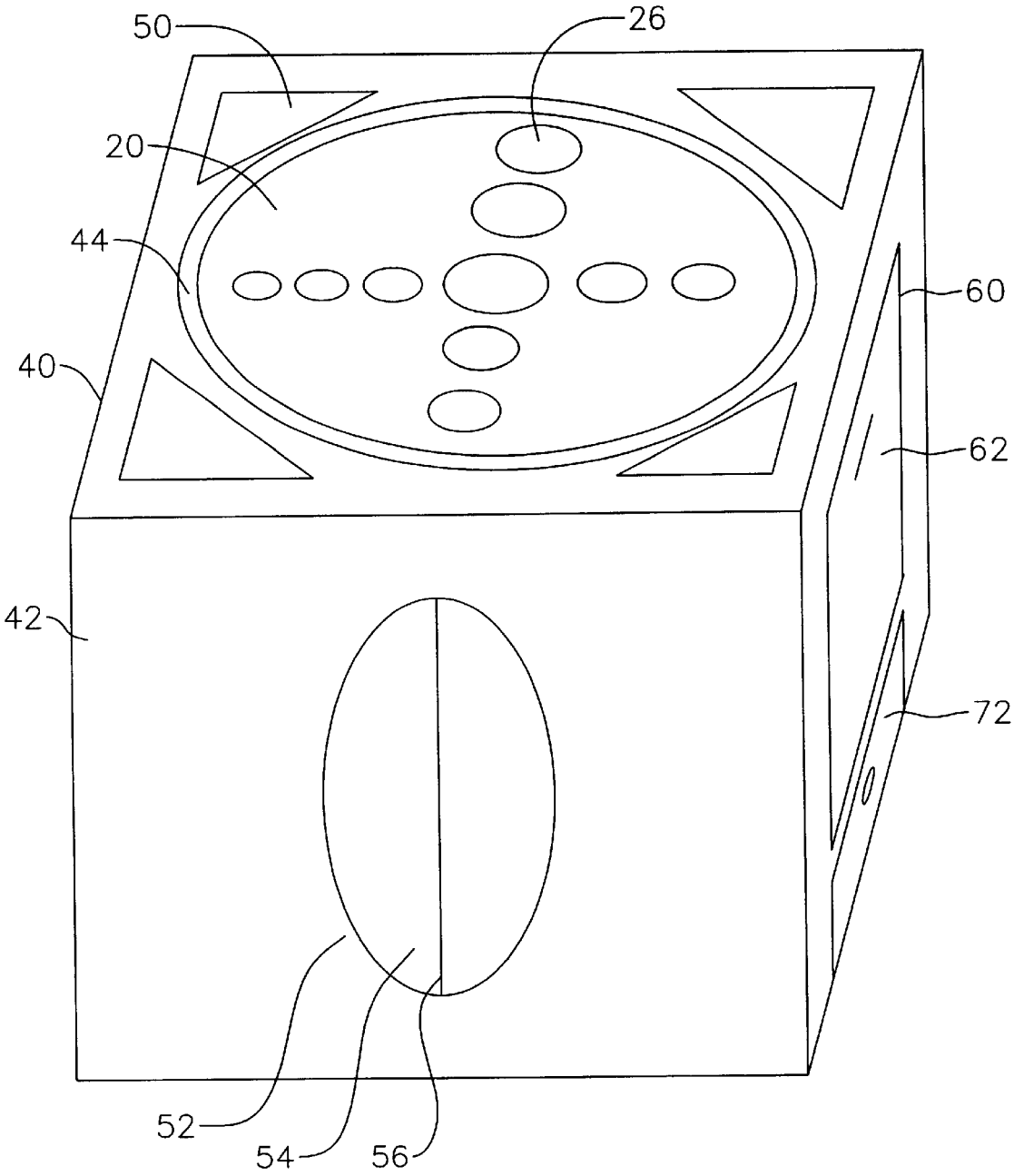
FIG. 2 is an elevated perspective view of an embodiment of a case with the container and cover of FIG. 1 disposed therein.
Figure 3:
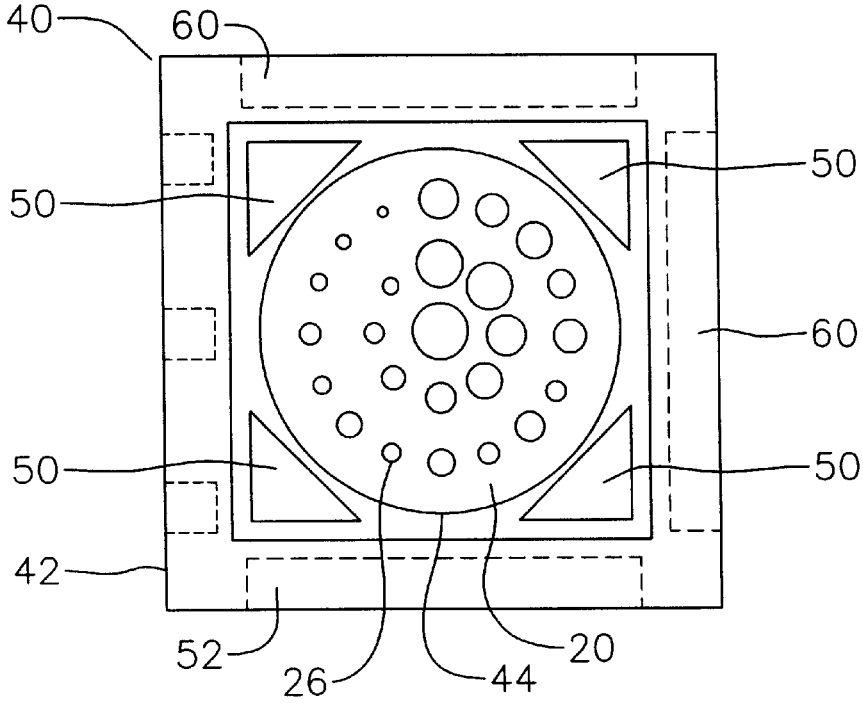
FIG. 3 is a top view of the container and case of FIG. 2.

Reference is now made to the figures wherein like parts are referred to by like numerals throughout. With reference to FIG. 1, the present invention includes a container 10 with an open end. In one embodiment of the present invention, the container 10 includes a substantially continuous base 12 and side walls 14. In an alternate embodiment, the container 10 includes an opening 16 on the side walls 14 or base 12. Such an embodiment may further include a door 18 pivotally mounted to the side walls 14 or base 12 to cover the opening 16.

A cover 20 is mounted over open end of the container 10. While the cover 20 may be permanently mounted to the container 10, in an optional embodiment, the cover 20 is removably secured to the container 10. The cover 20 may be mounted in a variety of ways. In the embodiment of FIG. 1, the cover 10 includes an annular skirt 22 that is received in a mating annular step 24 around the end of the container. The cover 20 includes a plurality of holes 26 disposed therethrough. The holes 26 are of at least three different diameters to accomodate pencils of a variety of diameters.

Disposed between the cover 20 and the container 10 are a number of sharpeners 30. Each sharpener 30 is positioned in registration with a hole 26 in the cover 20. The sharpeners 30 include a receiver 32 to receive and guide a pencil and a blade 34 disposed at an angle to the receiver 32. As shown in the figures, in an optional embodiment, the receiver 32 is substantially conical or frustoconical and the blade 34 is located along the wall of the receiver 32.

In use, a hole 26 approximating the diameter of the pencil is selected and the pencil is directed through the hole 26. The tip of the pencil is positioned in the receiver 32. Relative rotational movement between the blade 34 and the pencil allow the blade 34 to shave a predetermined thickness from the barrel and core of the pencil. It is contemplated that the current invention embraces both the blade 34 moving with respect to the pencil, such as occurs in cranked or motor-driven sharpeners, or the pencil moving with respect to the blade 34, as occurs in conventional sharpeners. Shavings from the barrel and core of the pencil are collected in the container 10 and may be disposed of by removing the cover 20 from the container 10 or, in an optional embodiment, opening a door 18 covering the opening 16 in the container 10.

With reference to FIGS. 2–8, in a further embodiment of the present invention, a removable case 40 may be provided. The case 40 includes supports 42 and a receptacle 44 that matingly receives the container 10. Optionally, the supports 42 are orthogonal to one another so that the supports 42 act as the faces of a generally rectangular parallelopiped case 40. In a further optional embodiment, the supports 42 are substantially equal in size to give the case 40 a generally cubical shape. The shape of the receptacle 44 in such an embodiment is complementary to the shape of the container 10 to closely receive the container 10. For example, in FIGS. 2–8, the receptacle 44 is a hollow cylinder slightly larger than the cylindrical container 10. As shown in the figures, the depth of the receptacle 44 may be equal to the height of the container 10 plus the cover 20 so that the cover 20 is substantially flush with the top of the case 40 when the container is inserted into the receptacle 44. Also, the receptacle 44 may be sealed from the container 10 so that the shavings are entirely captured and stored in the container 10.

The case 40 may optionally incorporate a variety of compartments, chambers, wells and the like to hold any number of accessories. For example, the embodiment of FIGS. 2–8 includes a plurality of compartments 50 disposed through the top of the case that are independent of the receptacle 44 and one another to prevent implements stored in the compartment 50 from commingling with the contents of another compartment 50 or the container 10 contained in the receptacle 44.

Figure 4:
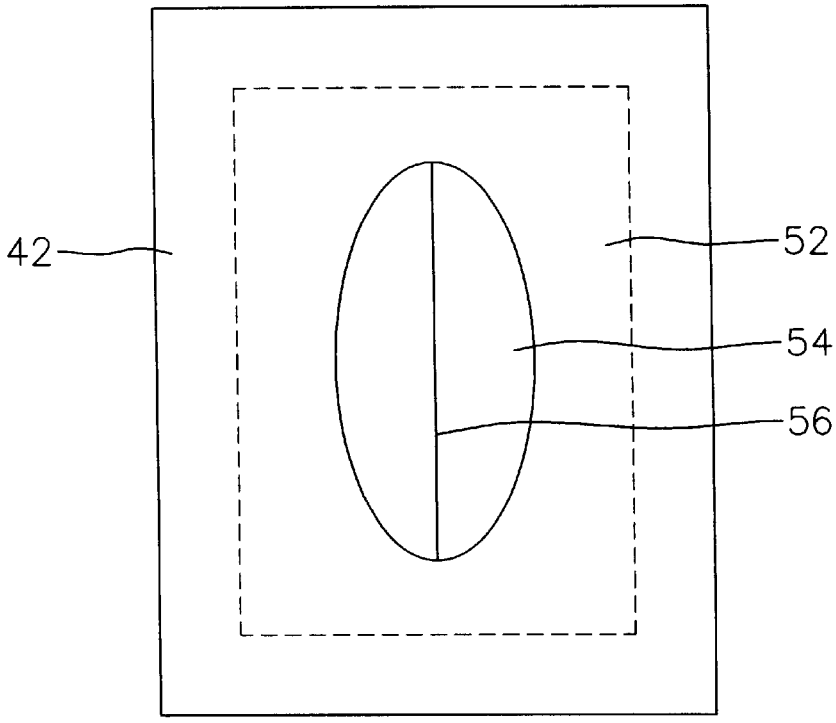
FIG. 4 is a front view of the case of FIG. 3.

Likewise, the optional embodiment of FIG. 4 includes a tissue dispenser 52. The tissue dispenser 52 includes cover 54 overlaying a recess holding tissues. Optionally, the cover 54 includes an access hole 56 to allow access to the tissues stored inside.

Figure 5:
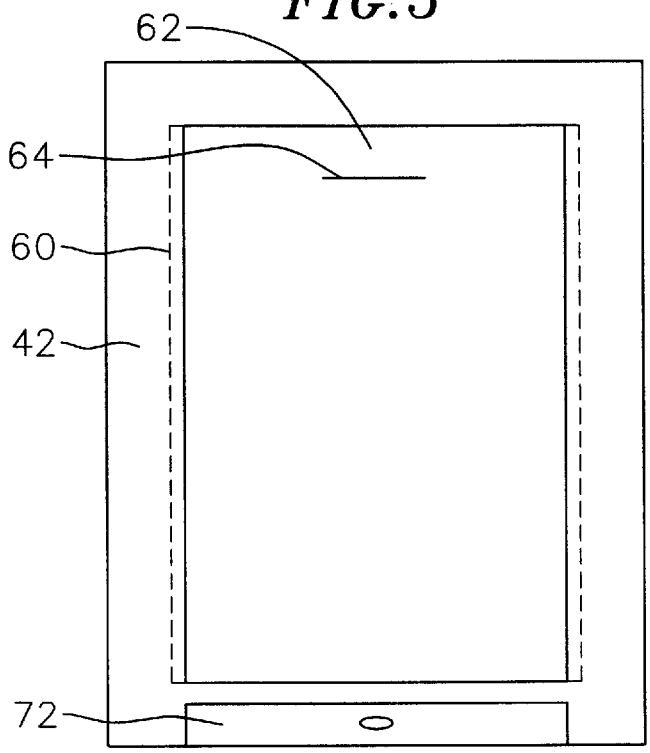
FIG. 5 is a right side view of the case of FIG. 3.
Figure 6:
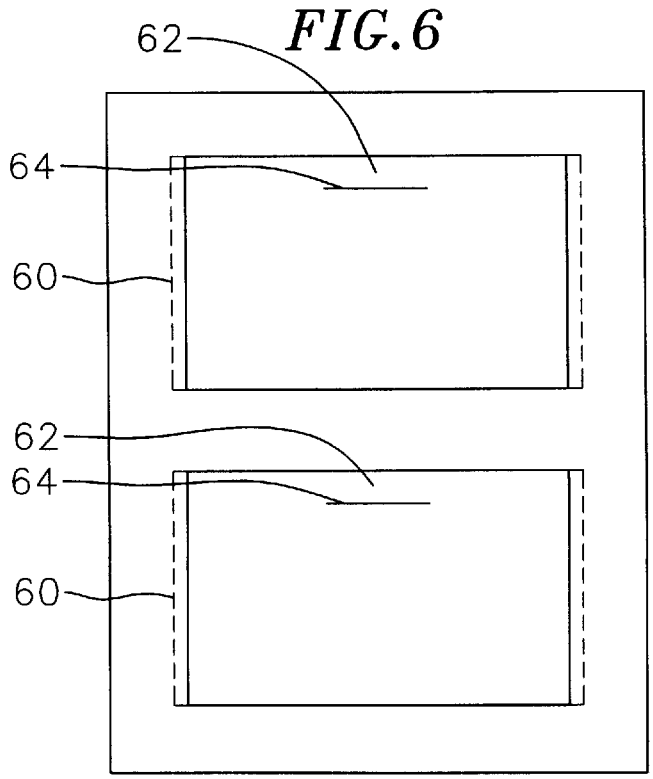
FIG. 6 is a rear view of the case of FIG. 3.

In yet another optional embodiment, the case 40 may include one or more closeable chambers 60 such as those shown in FIGS. 5 and 6. These chambers 60 may include a door 62 pivotally mounted to a support 42. The door 62 may include a handle 64. As shown in the figures, a chamber 60 may be of any size relative to a support 42.

Figure 7:
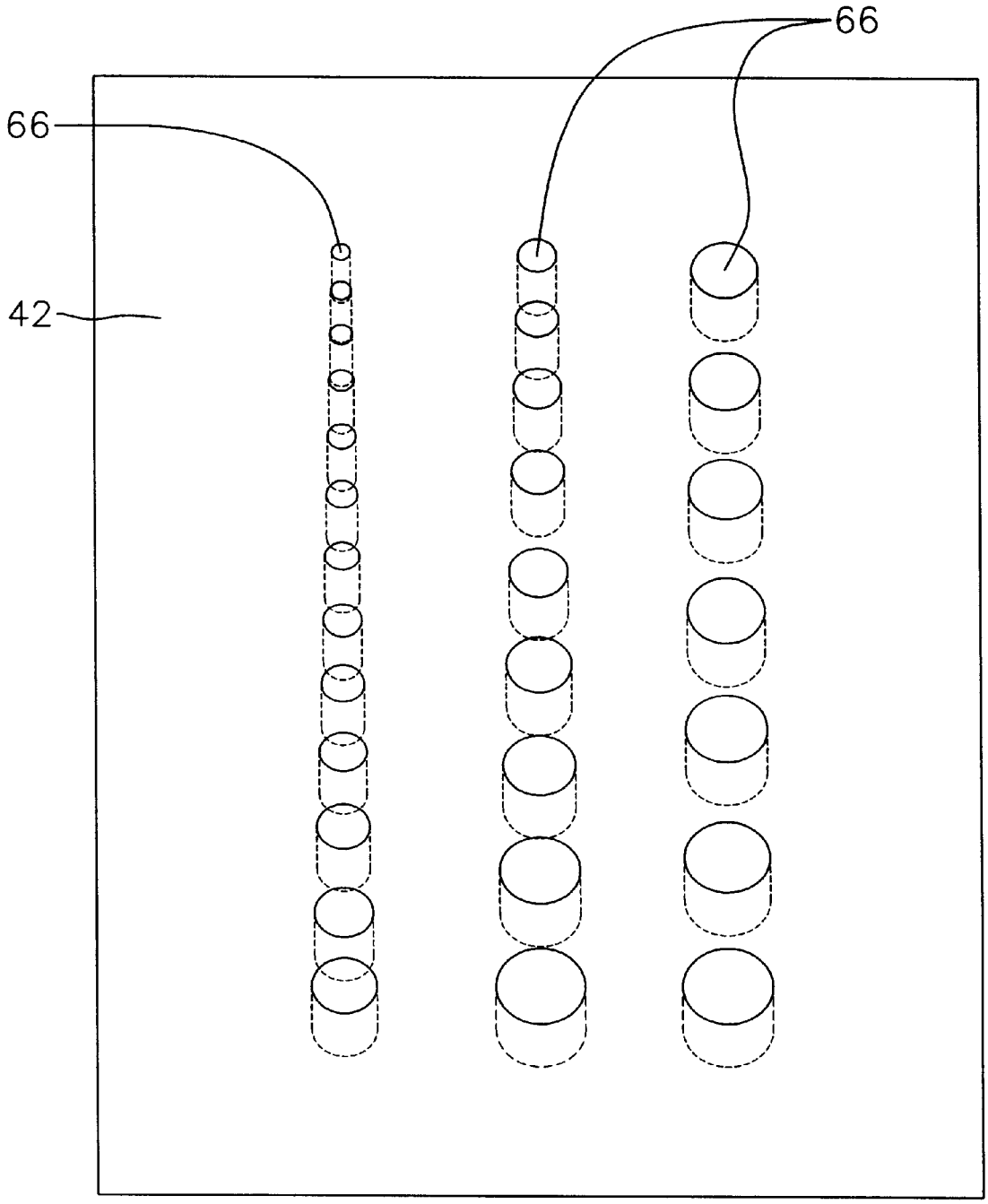
FIG. 7 is a left side view of the case of FIG. 3

In another optional embodiment, shown in FIG. 7, the case 40 includes a plurality of wells 66 disposed in the supports 42 for holding objects such as pencils or other instruments or accessories. In an optional embodiment, the wells 66 are of a variety of diameters to allow various sizes of objects, such as pencils, to be disposed therein. The wells 66 are optionally oriented at an angle acute to the supports 42 such that objects stored in the wells 66 are directed generally inward and downward.

Figure 8:
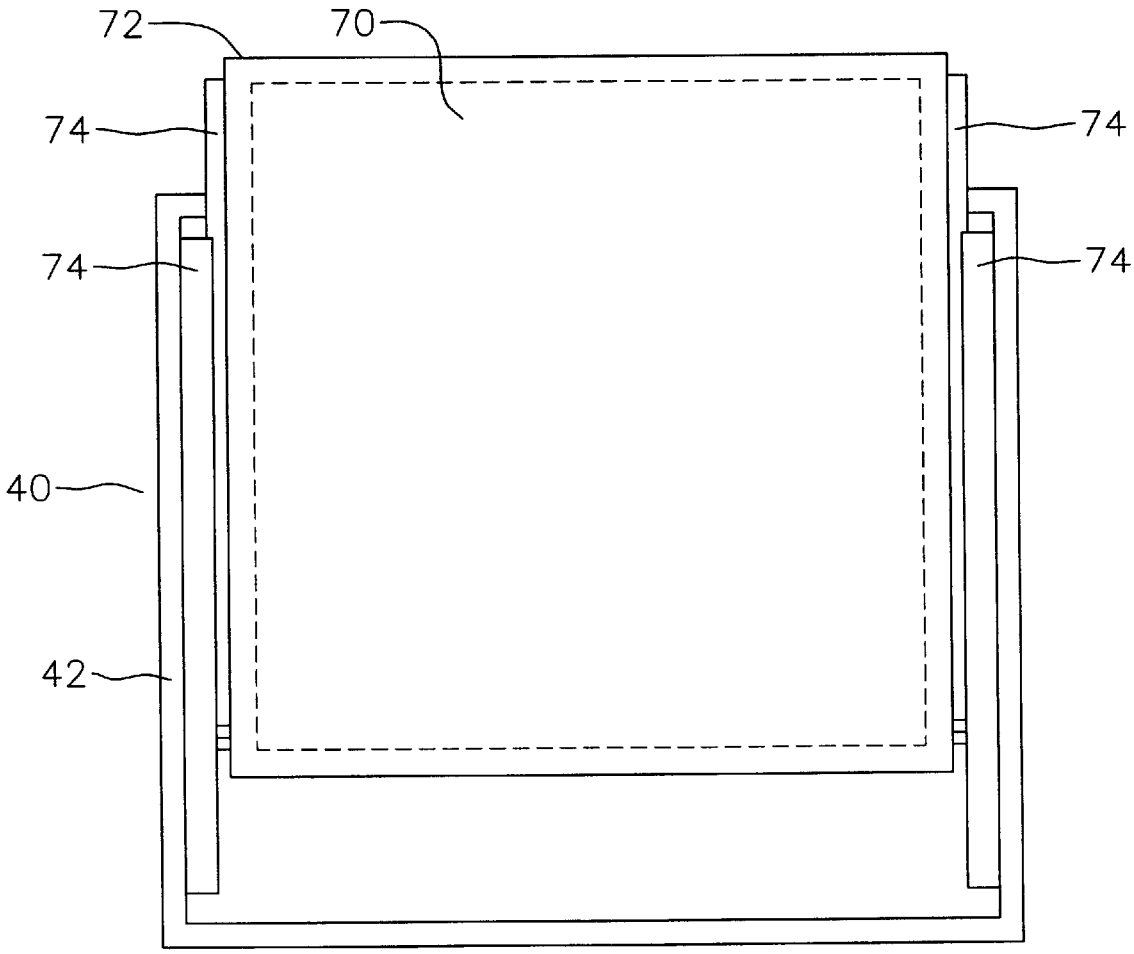
FIG. 8 is a partial bottom view of the case of FIG. 3.

Optionally, a mirror 70 may be provided with the case 40 as shown in FIG. 8. In such an optional embodiment, the mirror 70 is mounted to a backing 72. The backing 72 is slidably connected to the supports 42 using, for example, mating runners 74 mounted to the backing 72 and the supports 42. In such an embodiment, the backing 72 may be moved between two positions, a stored position in which the mirror 70 is enclosed in the case 40 and a deployed position in which the mirror 70 is outside the case 40. The mirror 70 of FIG. 8 is shown in an intermediate position. In a further optional embodiment, the mirror 70, or alternatively the mirror 70 and backing 72, may be detachable from the tracks 74 when the backing 72 is moved to the deployed position. As shown in FIG. 8, the backing 72 may optionally be connected proximate the bottom of the supports 42 so that the backing 72 forms the base of the case 40 when in the stored position.

While certain embodiments of the present invention have been shown and described it is to be understood that the present invention is subject to many modifications and changes without departing from the spirit and scope of the claims presented herein.

I claim:

1. A device for sharpening cosmetic pencils of the type having a core surrounded by an annular barrel, comprising:

a container having a base, side walls, and an open end, said container including an opening and a door pivotally attached to said container over said opening;

a cover mounted to the open end of the container having a plurality of holes arrayed thereon, at least three of said holes having a different diameter;

a sharpener disposed in registration with each of said holes between said container and said cover, each sharpener including a receiver for receiving a cosmetic pencil and a metal blade disposed at an angle with respect to said receiver;

a case having supports and a top, the top including a receptacle therein with a shape complementary to said container to removably matingly receive said container, the supports including a plurality of wells disposed therein at an acute angle thereto, at least three of said wells having a different diameter;

a closeable storage chamber pivotally disposed in one of said supports;

a mirror mounted to a backing slidably connected to the bottom of said supports such that the mirror moves between a stored position in which the mirror is enclosed in said case and said backing forms the base of said case and a deployed position in which the mirror is outside said case; and a plurality of compartments independent of one another and independent of said receptacle disposed in the top of said case parallel to said receptacle.

2. A device for sharpening cosmetic pencils of the type having a core surrounded by an annular barrel, comprising:

a container with an open end;

a cover mounted to the open end of the container having a plurality of holes arrayed thereon, at least three of said holes having a different diameter;

a sharpener disposed in registration with each of said holes between said container and said cover, each sharpener including a receiver for receiving a cosmetic pencil and a metal blade disposed at an angle with respect to said receiver; and a case having supports and a receptacle to removably matingly receive said container.

3. The device of claim 2 wherein said case further comprises a closeable storage chamber disposed in one of said supports.

4. The device of claim 2 wherein said case further comprises a mirror mounted to a backing slidably connected to said supports such that the mirror moves between a stored position in which the mirror is enclosed in said case and a deployed position in which the mirror is outside said case.

5. The device of claim 4 wherein the backing is slidably mounted to the bottom of said supports such that the backing forms the base of said case when the backing is in the stored position.

6. The device of claim 2 wherein said case includes a plurality of compartments independent of one another and independent of said receptacle.

7. The device of claim 2 wherein said case includes a plurality of wells disposed in said supports.

8. The device of claim 2 wherein said container includes an opening, the container further comprising a door attached to container over said opening.

9. A device for sharpening cosmetic pencils of the type having a core surrounded by an annular barrel, comprising:

a container having a base, side walls, and an open end;

a cover mounted to the open end of the container having a plurality of holes arrayed thereon, at least three of said holes having a different diameter;

a sharpener disposed in registration with each of said holes between said container and said cover, each sharpener including a receiver for receiving a cosmetic pencil and a metal blade disposed at an angle with respect to said receiver; and a case with a receptacle to removably matingly receive said container.

10. The device of claim 9 wherein said container includes an opening, the container further comprising a door pivotally attached to said container over said opening.

11. The device of claim 9 wherein said case includes supports, said case further comprising a closeable storage chamber disposed in one of said supports.

12. The device of claim 9 wherein said case includes supports, said case further comprising a mirror mounted to a backing slidably connected to said supports such that the mirror moves between a stored position in which the mirror is enclosed in said case and a deployed position in which the mirror is outside said case.

13. The device of claim 12 wherein the backing is mounted to the bottom of said supports such that the backing forms the base of said case when the backing is in the stored position.

14. The device of claim 9 wherein said case includes a plurality of compartments independent of one another and independent of said receptacle disposed parallel to said receptacle.

15. The device of claim 9 wherein said case includes supports, said case further comprising a plurality of wells disposed in said supports at an acute angle thereto, at least three of said wells having a different diameter.

* * * * *